US007007882B2

(12) United States Patent
Raia et al.

(10) Patent No.: US 7,007,882 B2
(45) Date of Patent: Mar. 7, 2006

(54) RETRACTABLE BADGE REEL WITH BILLBOARD DISPLAY

(75) Inventors: Richard M. Raia, Lexington, MA (US); Robert N. Brosofsky, Tewksbury, MA (US); Matthew Lynch, Watertown, MA (US); Lee Porter, Keene, NH (US); Angela Ping Tsui, Lexington, MA (US)

(73) Assignee: Comprehensive Identification Products, Inc., Burlington, MA (US)

( * ) Notice: Subject to any disclaimer, the term of this patent is extended or adjusted under 35 U.S.C. 154(b) by 65 days.

(21) Appl. No.: 10/730,497

(22) Filed: Dec. 8, 2003

(65) Prior Publication Data

US 2004/0188557 A1 Sep. 30, 2004

Related U.S. Application Data

(60) Provisional application No. 60/433,075, filed on Dec. 13, 2002.

(51) Int. Cl.
*B65H 75/48* (2006.01)

(52) U.S. Cl. ..... 242/379; 242/379.2; 242/380; 33/769

(58) Field of Classification Search ..... 242/379, 242/379.2, 380; 33/768, 769
See application file for complete search history.

(56) References Cited

U.S. PATENT DOCUMENTS

| | | | | |
|---|---|---|---|---|
| 812,150 | A | | 2/1906 | McLean |
| 1,443,194 | A | | 1/1923 | Pichler |
| 2,732,146 | A | | 1/1956 | Lummis |
| 3,968,670 | A | | 7/1976 | Quenot |
| 4,646,987 | A | * | 3/1987 | Peterson ..... 242/378.3 |
| 5,079,851 | A | * | 1/1992 | Sill ..... 33/760 |
| 5,791,076 | A | | 8/1998 | Gailliard |
| 5,815,873 | A | | 10/1998 | Jones |
| 5,833,165 | A | | 11/1998 | Paugh |
| 5,954,288 | A | * | 9/1999 | Shih ..... 242/380 |
| 6,073,875 | A | | 6/2000 | Paugh |
| 6,226,905 | B1 | | 5/2001 | Osune |
| 6,290,158 | B1 | | 9/2001 | Huang |
| 6,364,237 | B1 | | 4/2002 | Kagel |
| 2004/0089759 | A1 | * | 5/2004 | Genuise ..... 242/379 |

OTHER PUBLICATIONS

UNI-Lockey Catalog 2002-2003, Front and Back Covers and p. 9 showing Item # P207/ID-0003.

* cited by examiner

*Primary Examiner*—Kathy Matecki
*Assistant Examiner*—Sang Kim

(57) ABSTRACT

A retractable badge reel with a billboard designed to display a logo, such that unadorned badge reels can be manufactured separately from the billboards that contain the logos. The billboard is optionally removable, allowing the logo being displayed to be changed without having to produce new retractable badge reels in their entirety. In another embodiment, a billboard designed to display a logo is adapted to be installed over the face of an existing retractable badge reel, such that the logo on the existing unit is hidden and the new logo on the billboard is instead displayed. A casement comprising the billboard and a back housing member have a mating portion that mates with a bob mating portion of a bob attached to the exterior end of the retractable cord to prevent the bob from shifting or twisting when the cord is in the retracted position.

12 Claims, 13 Drawing Sheets

RETRACTABLE BADGE REEL WITH BILLBOARD DISPLAY

This application claims priority from U.S. Provisional Patent Application Ser. No. 60/433,075, filed 13 Dec. 2002, the disclosure of which is hereby incorporated herein by reference.

FIELD OF THE INVENTION

This invention relates to a retractable badge reel, and more specifically to such a badge reel incorporating a replaceable and interchangeable display member, which the inventors have termed a "billboard."

BACKGROUND OF THE INVENTION

A retractable badge reel is a device comprising a case inside of which is a reel with a cord wrapped around it. The reel is configured such that the free end of the cord can be pulled, thereby rotating the reel. Cord tension is provided by a flat coil spring; as the cord is pulled out of the case, the spring tightens. When the end of the cord is released, the cord can be rewound—either automatically by the unwinding of the spring; or through some manual manipulation, e.g., winding of a lever or via a push-button release, which allows the spring to rewind the cord. The case typically has a clip on its backside for securing it to a shirt pocket, pants waistband, or the like, of a wearer. The free end of the cord is usually attached to a bob, which in turn is attached to a badge holding strap. The face side of the badge reel (opposite the clip side) may either be plain and unadorned, or it may contain permanent markings, such as logos, names and telephone numbers, pictorial displays, or the like. Devices of this type are shown in U.S. Pat. Nos. 1,442,194, 2,732,148, 3,968,670, 5,815,873, 5,833,165, 6,073,875, 6,290,158 and 6,364,237, the disclosures of which are hereby incorporated herein by reference.

The purpose of the retractable badge reel is to allow a wearer to attach a badge to the badge holding strap and to clip the badge reel to his or her clothing. The badge is usually of the type that contains identifying information concerning the wearer, and which may be readable by a conventional electronic sensing device. In this latter case, the badge typically includes an electronic "chip" or a magnetic strip that has been encoded with certain identification information that is read by the sensor. Typically, the wearer would either present the badge to someone who would "scan" it using a handheld sensing device for example, or the wearer could be required to slide or "swipe" the badge through a stationary sensing device. In this way, the badge can be used as an electronic ID for security purposes, or to allow an employee to time in or out, etc.

U.S. Pat. No. 6,290,158 describes a reel device having a housing made up of an upper lid and a bottom lid. The upper lid has a hole designed for receiving a decorative piece, which can be sized and shaped to match the hole or can be made of a pad that is sandwiched between the upper lid and a lining sleeve that sits atop the reel interior. To achieve a decorative design on the face of the reel, the upper lid and decorative piece must be installed to cover over the central hole through which a rivet passes, holding the reel together. The presence of the rivet extending through the central hole makes the imprinting of the lining sleeve so as to have the face of the lining sleeve be the visible outer face of the housing undesirable. In this fashion, the reel device requires a multitude of components to achieve a decorative marking.

Further, there is no teaching that the decorative piece or the upper lid is removable to allow for changing of the decorative element once the reel has been assembled.

U.S. Pat. No. 6,073,875 describes a retraction reel for keys and the like which contains a cable attached at one end to the reel and at the other end to a cable fitting. The housing of the reel contains a slot just wider than the cable that widens at one end to a width just larger than the width of the cable fitting to form a rest receptacle. When in the retracted position, the cable fitting rests in the rest receptacle, and when being retracted the cable fitting is pulled perpendicularly so that the cable extends out of the slot at the smaller width. In this fashion, the cable is pulled in a straight line from the reel and not forced to bend to pass through a hole in the housing. The retraction reel of this patent has a conventional housing, with a front face attached to a back face by means of screws. The cable fitting is not prevented from moving or spinning when in the retracted position due to the wide portion of the slot being long enough to permit the cable fitting to be pulled perpendicularly, and due to the fact that the cable fitting is of a tubular shape and thus capable of spinning in the slot.

U.S. Pat. No. 6,364,237 describes a retractable badge reel with a window located on the front face of the case through which a design or logo can be seen. When the cord is pulled out of the case, it causes the design to rotate or spin. Similarly, when the cord is retracted into the case, the logo spins. The design or logo is attached to a display plate that is attached to the reel in the only embodiment presented, such that the plate and the design rotate along with the reel. As such, the cost and effort associated with changing a logo or design on a fully assembled unit would be high. The displays presented would also be inappropriate for usage on other preexisting retractable badge reels.

SUMMARY OF THE INVENTION

A design, pattern, photograph, description, symbol, logo or the like (collectively referred to hereinafter as a "logo") is often imprinted on the front side of the case where it is visible to anyone looking at the badge reel. However, for the manufacturer (and other sellers or users) of such devices, the custom printing of logos directly on the front of the badge reel case often represents an economic problem. For example, if a customer orders 10,000 custom imprinted units, but only accepts delivery of 5,000 units, the manufacturer can do little with the remaining units. Likewise, buyers and/or end users may want to change logos, e.g., of seasonal sports teams, on the badge reel.

The present invention addresses this problem by allowing the manufacturer of badge reels to make unadorned cases to which can be attached separate members that contain any desired logo. Such a member is referred to hereinafter as a "billboard display," or simply "billboard." The billboard may either be adapted to be attached directly to the unadorned case (or one with a "wrong" logo) so as to face outwardly from the wearer, with the outwardly-facing portion adapted to receive and display a custom logo. Similarly, different billboard displays may be attached to an adapter that is mounted, either to the case in a permanent or removable manner.

Various logos can be embossed or imprinted or otherwise applied to the outwardly-facing portion of the billboard, or can be embossed or imprinted or otherwise applied to an outwardly-facing portion of a billboard attachment which is attached to a billboard universal adapter to together make up the billboard.

The billboard is inexpensive to produce and to imprint a custom logo upon and is designed to mount, either permanently or temporarily, onto the front side of the badge reel case. As described above, if not mounted directly to the badge reel case, the billboard may be mounted to a billboard universal adapter, which is designed to mount, either permanently or temporarily, onto the front side of a badge reel case. In this way, cases can be manufactured in bulk without modification, and the billboards can be customized and attached as required.

The advantages of such a product include the reduced costs associated with producing and assembling the unmodified units in bulk; the ability to remove the billboard containing the logo from badge reels, thus placing only the billboard display at risk of loss in the above scenario rather than the entire unit; and the increased speed of response to an order, given that the badge reels could be assembled in advance and stockpiled, awaiting only the addition of the display. In embodiments comprising both a billboard universal adapter and a billboard attachment, the universal adapter can also be manufactured in bulk, awaiting only the addition of the billboard attachment. The billboard can also be used to salvage previously imprinted badge reel cases in order to hide the previous imprint.

Accordingly, the present invention is directed toward an improvement to the existing retractable badge reels as described above. This improvement involves creating a billboard upon which a custom logo can be imprinted or embossed or otherwise applied. The billboard display can comprise either a single piece or optionally it can comprise a billboard universal adapter and a separate billboard attachment containing a logo. The billboard display is optionally removable such that the logo being displayed can be removed or changed, either by the manufacturer in response to changes in orders or by the end-user, who may wish to display alternating logos or other displays.

The logo on the billboard can be incorporated in a number of ways. For example, the logo could be formed into the exterior facing surface of the billboard, such as by embossing. The logo could also be formed over the surface of the exterior facing side of the billboard, for example using paint, ink or silkscreen. Alternately, the billboard could be made using a label. In this latter case, the logo would be on a front side of the label, which would be attached to the billboard by its back side. Yet another alternative would have a recessed portion, a slot or a sleeve with a clear face on the front face of the billboard adapted to receive a billboard insert, which could itself be imprinted, embossed, or labeled with the desired logo. Similarly, each of these methods of incorporating the logo could be used to incorporate the logo onto a billboard attachment, which would then attach to a billboard universal adapter to form the billboard.

In certain preferred embodiments, the badge reel also includes a cord, which in its normal mode is fully retracted within the case with the exception of a free end that extends outside the case through a hole in its periphery. This cord is attached at its free end to a badge-securing unit that is capable of releasably attaching a badge to the badge reel. The cord can be manually extended from the case by a user, so that a badge attached to the badge reel can be presented for inspection or electronic sensing, as described previously. The cord is under tension from within the case such that when extended and released, or when the free end of the cord is guided back toward the case by the user, the tension on the cord causes it to retract back into the case.

The badge-securing unit of the badge reel preferably includes a bob that is connected to the free end of the cord. This bob is larger than the hole in the periphery of the case though which the cord extends so as to prevent the free end of the cord from retracting completely into the case. The bob is optionally configured to mate with a mating portion of the case to hold the bob, and by it a badge strap, clip, or other mounting fastener, in a manner so as to reduce the ability of the bob to twist or bend, approximating a rigid connection between the case and a badge strap, clip, or other mounting fastener.

The badge-securing unit may optionally include a conventional badge strap, clip, or other mounting fastener, that is connected to the bob. A badge can be releasably attached to the strap, clip, or other mounting fastener, in a traditional manner. Further, the badge reel includes a releasable attachment clip that is connected to a backside of the case. This clip is capable of releasably attaching the case to the belt, lapel, pocket, or elsewhere on the clothing of a user. In this way, a badge attached to a badge strap, clip, or other mounting fastener would hang down from the badge reel when the cord is in its fully retracted mode so that it could be placed in plain view of others in the vicinity of the person wearing the badge reel. It is noted that the tension applied to the cord in it fully retracted mode is sufficient to hold the bob against the periphery of the case when a badge is attached to a badge strap, clip, or other mounting fastener. This ensures that the weight of the badge alone does not cause the cord to extend. It is also noted that the length of the cord is such that the user can extend the cord a sufficient distance to present the badge for inspection or sensing without pulling the badge reel off of the user's clothing.

The case of the badge reel can have any desired shape. For example, the case when viewed from its front side can have a shape approximating a circle, ellipse, or some form of a polygon (e.g., a triangle, square, rectangle, hexagon, etc.). The billboard display can also take on any desired shape, and need not be the same as the case. When the billboard display comprises a billboard universal adapter and a separate billboard attachment, the billboard attachment can be any shape and size in relation to both the case and the billboard universal adapter. For example, the billboard attachment could be square, round, oval, rectangular, triangular, heart-shaped, or any other desired shape.

In another preferred embodiment, the billboard display is designed to fit over an existing retractable badge reel. Such a display would advantageously allow users to change the logo being displayed when, for example, their company changed names or redesigned logos, without having to repurchase the entire badge display. Users can also change the shape and size of the display area by using a billboard display that is of a different shape; such might be useful when more information is desired to be displayed. This embodiment also allows manufacturers to reuse badge reels that have previously had a design irremovably incorporated onto the holder, for example when number of units have been imprinted incorrectly or have been imprinted and then not accepted, by covering the existing logo with the billboard.

In addition to the just described benefits, other objectives and advantages of the present invention will become apparent from the detailed description which follows hereinafter when taken in conjunction with the drawing figures which accompany it.

BRIEF DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

In the following description of the preferred embodiments of the present invention, reference is made to the accompanying drawings that form a part hereof, and in which is shown by way of illustration specific embodiments in which the invention may be practiced. It is understood that other embodiments may be utilized and structural changes may be made without departing from the scope of the present invention.

Figure 1A:
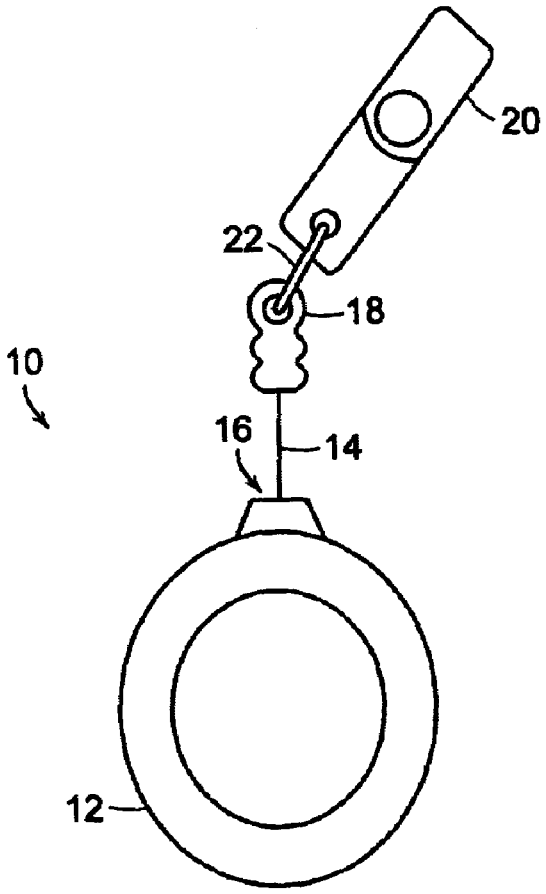
FIG. 1A PRIOR ART
FIG. 1A is a front view of a retractable badge reel according to the Prior Art.
Figure 1B:
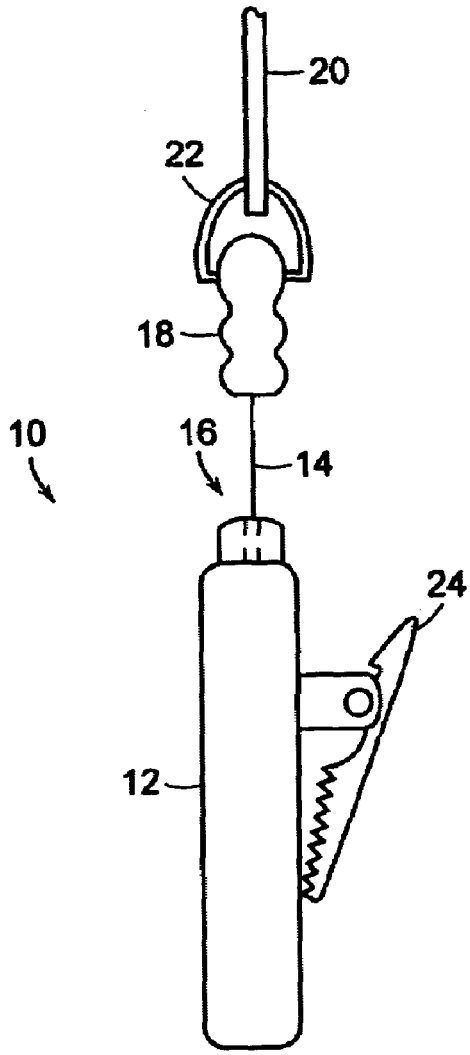
FIG. 1B PRIOR ART
FIG. 1B is a side view of a retractable badge reel according to the Prior Art.
Figure 2A:
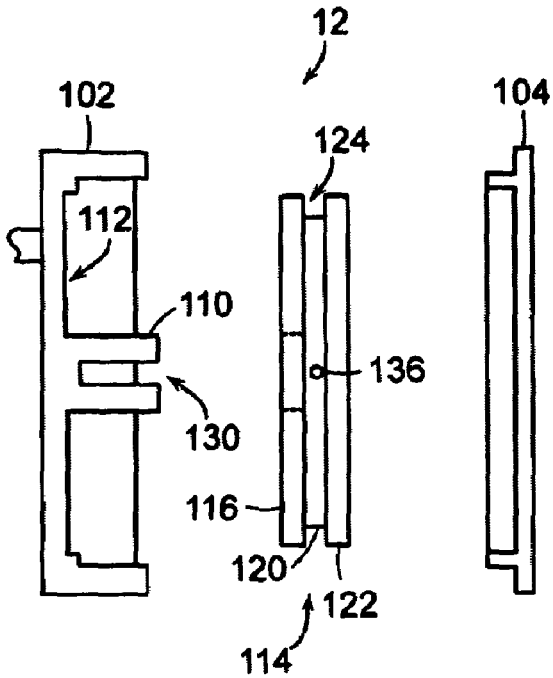
PRIOR ART FIG. 2A
FIG. 2A is partially cross-sectional, exploded, side view of the components making up the case of the retractable badge reel of FIGS. 1A and 1B.
Figure 2B:
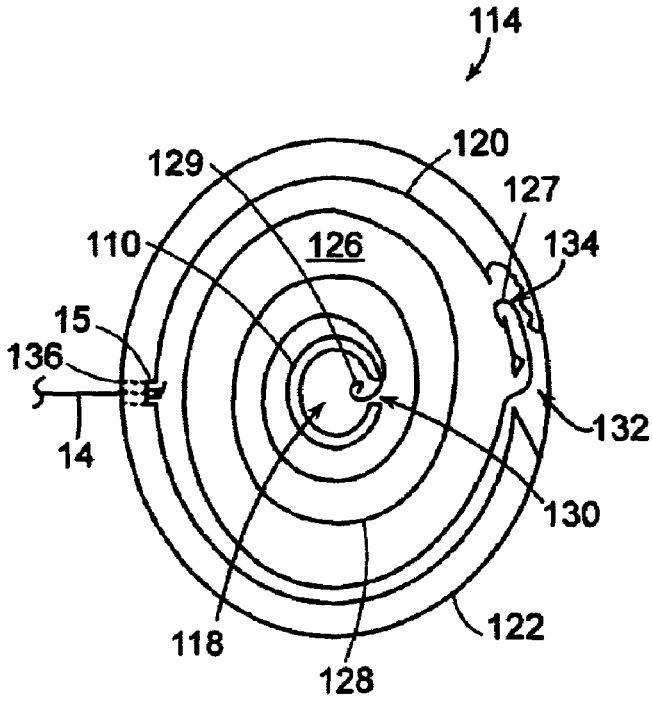
PRIOR ART FIG. 2B
FIG. 2B is a front view of a reel of the retractable badge reel of FIGS. 1A and 1B, including a wind-up spring disposed in the central cavity of the reel.

FIGS. 1A and 1B depict a typical prior art retractable badge reel. Generally, the retractable badge reel 10 is a device having a case 12 inside of which is an extendable and retractable cord 14. The case 12 is shown in FIG. 1A as having a circular shape; however, the case 12 can have any shape desired, such as an elliptical shape (e.g., oval) or polygonal shape (e.g., triangular, square, rectangular, hexagonal, etc.), as desired. The cord 14 passes from the interior of the case 12 to the exterior through a port 16 located along the peripheral edge of the case. The end of the cord 14 extending through to the exterior side of the case 12 is attached to a bob 18, which is physically larger that the port. The cord 14 is under tension from within the case 12 such that it tends to want to retract into the case. In a fully retracted mode, the bob 18 is pulled by the tensioned cord 14 against the exterior of the case 12. The presence of the bob prevents the cord 14 from retracting completely into the case. The bob 18 is connected to a conventional badge strap 20 via any appropriate connector, such as the connecting ring 22 shown in FIGS. 1A and 1B.

Optionally, the tensioned cord 14 may connect directly to a badge strap, clip, or other mounting fastener 20, with no bob or connector. In this case, a badge strap, clip, or other mounting fastener 20 acts to prevent the cord from retracting completely into the case. Similarly, the tensioned cord 14 may attach to a connector directly with no bob. A badge (not shown), such as those mentioned previously is attached to a badge strap, clip, or other mounting fastener 20 when the retractable badge reel 10 is in use. The badge reel can be clipped to the wearer via any appropriate releasable device, such as the clip 24 shown attached to the backside of the case 12 in FIG. 1B.

The badge reel's normal mode is the aforementioned retracted mode. In the retracted mode, the badge hangs down from the badge reel, which is typically clipped to the clothing (e.g., shirt pocket, pants waistband, jacket lapel, etc.) of a person wearing the badge via clip 24. When the badge is to be presented or "swiped" as described previously, the wearer pulls on the badge or a badge strap, clip, or other mounting fastener 20 away from the case 12 of the badge reel. The portion of the cord 14 contained within the case 12 is played out as the wearer pulls. It is noted that the length of the cord 14 is made long enough so that the badge can be readily presented or "swiped" by a user without the cord being fully extended from the case. For many applications, a cord length of approximately 2–3 feet is sufficient. When the wearer releases the badge, or guides it back toward the badge reel 10, the tension placed on the cord 14 pulls the cord back into the case 12, until the bob 18 butts against the periphery of the case. In this way the badge can be extended and retracted as needed.

Figure 3B:
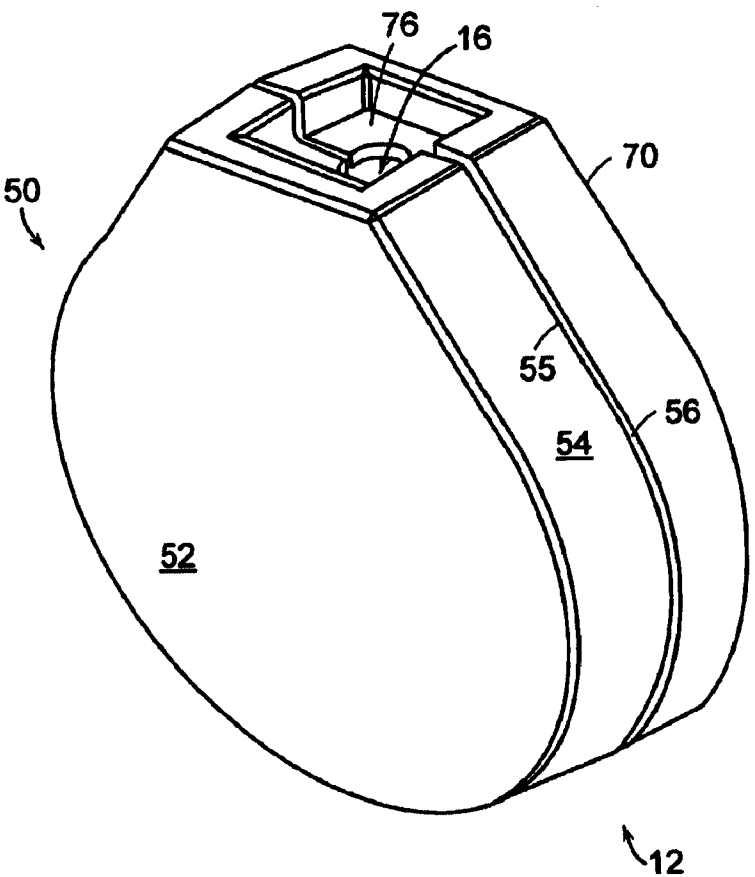
FIG. 3B is a perspective view of the billboard shown almost completely inserted into a back housing member.
Figure 3A:
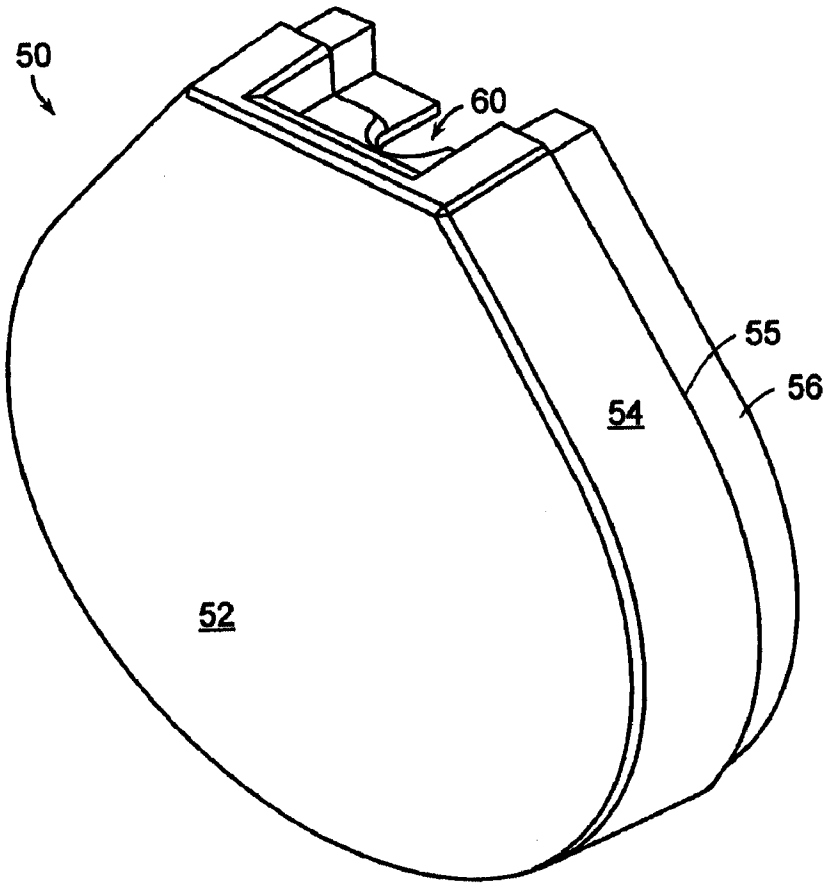
FIG. 3A is a perspective view of a billboard, without showing a logo included thereon.
Figure 7:
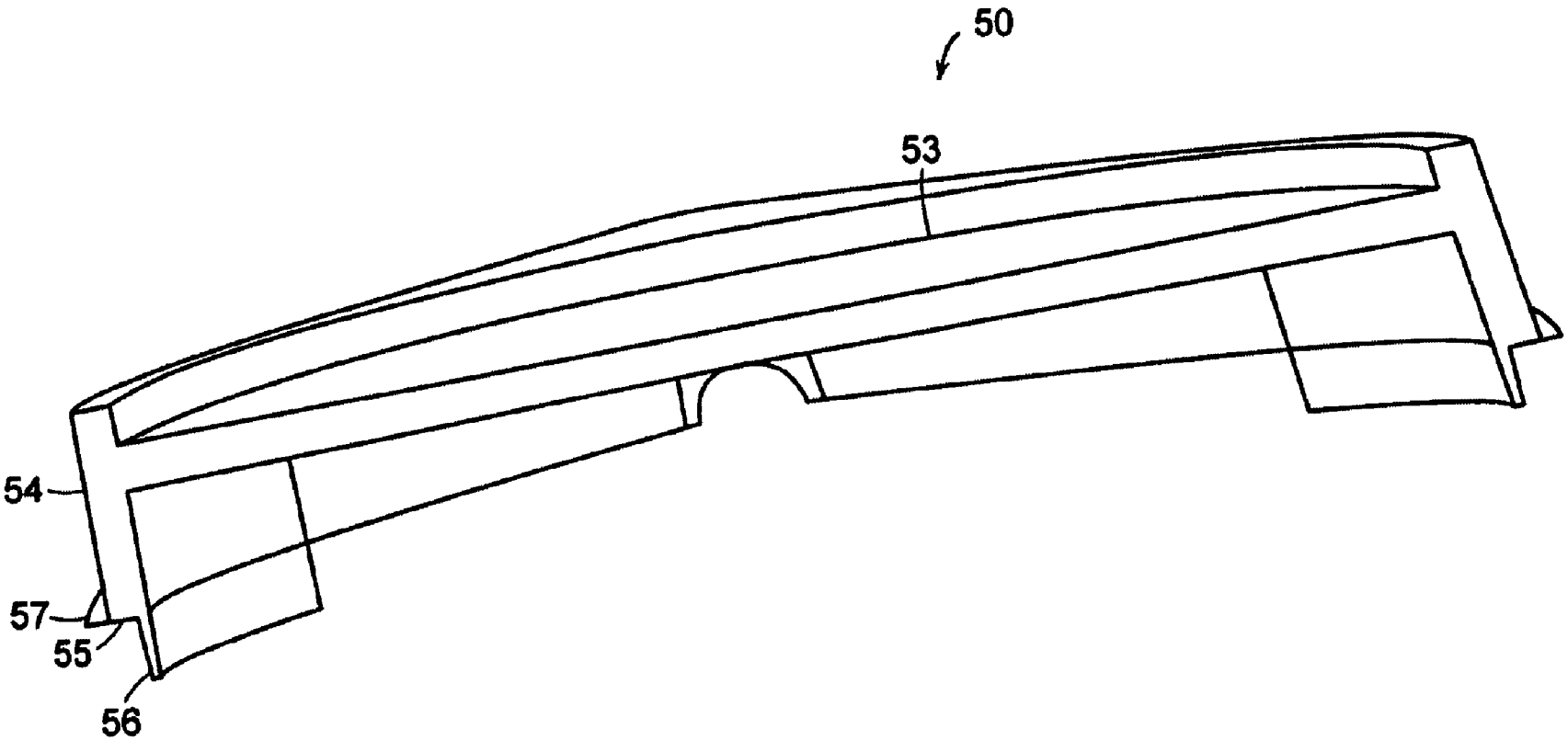
FIG. 7 is a cross-sectional view of the billboard shown in FIG. 4.

One preferred embodiment of the billboard of the present invention is displayed in FIGS. 3A and 3B. The billboard 50 comprises a front face 52 upon which the logo is located. The billboard has a side wall 54 extending perpendicularly away from the front face. Side wall 54 contains a shoulder 55 leading to an insertable portion 56 such that the outer surface of the insertable portion is located closer to the interior of the billboard than that of the side wall. The insertable portion is designed to snap-fit onto a back housing member 70 to form the case 12 wherein the side wall of the back housing member preferably abuts the shoulder 55 such that the outer surfaces of the side wall of the billboard and the back housing member form a substantially smooth interface. In another embodiment, exemplified in FIG. 7, the side wall 54 of the billboard has an external ridge 57 located just above the shoulder 55. This external ridge is advantageous in that it provides a leverage point for the separation of the billboard from the back housing member, facilitating the changing of the logo being displayed. Alternatively, the insertable portion and optional external ridge may be located on the back housing member rather than on the billboard.

Optionally, the billboard is a separate piece designed to fit over the front of case 12. The back housing member may also optionally be a separate piece designed to fit over the back of the case 12. Where the back housing member is a separate piece that fits over the case 12, the clip 24 may be located on the back housing member 70 or alternatively may be located on the case 12 and pass through a cutout in the back housing member.

The billboard 50 contains at a portion of the side wall 54 a slot 60. This slot meets up with a slot 61 in the back housing member 70 when the billboard and the back housing member are coupled to form port 16 through which the cord passes. Other suitable means for attaching the billboard to the back housing member will be apparent to those of ordinary skill in the art, given the benefit of the present disclosure. As noted above, while the case formed in FIG. 3B is substantially circular, any shape may be incorporated, such as an elliptical shape or a polygonal shape, as desired.

Figure 4:
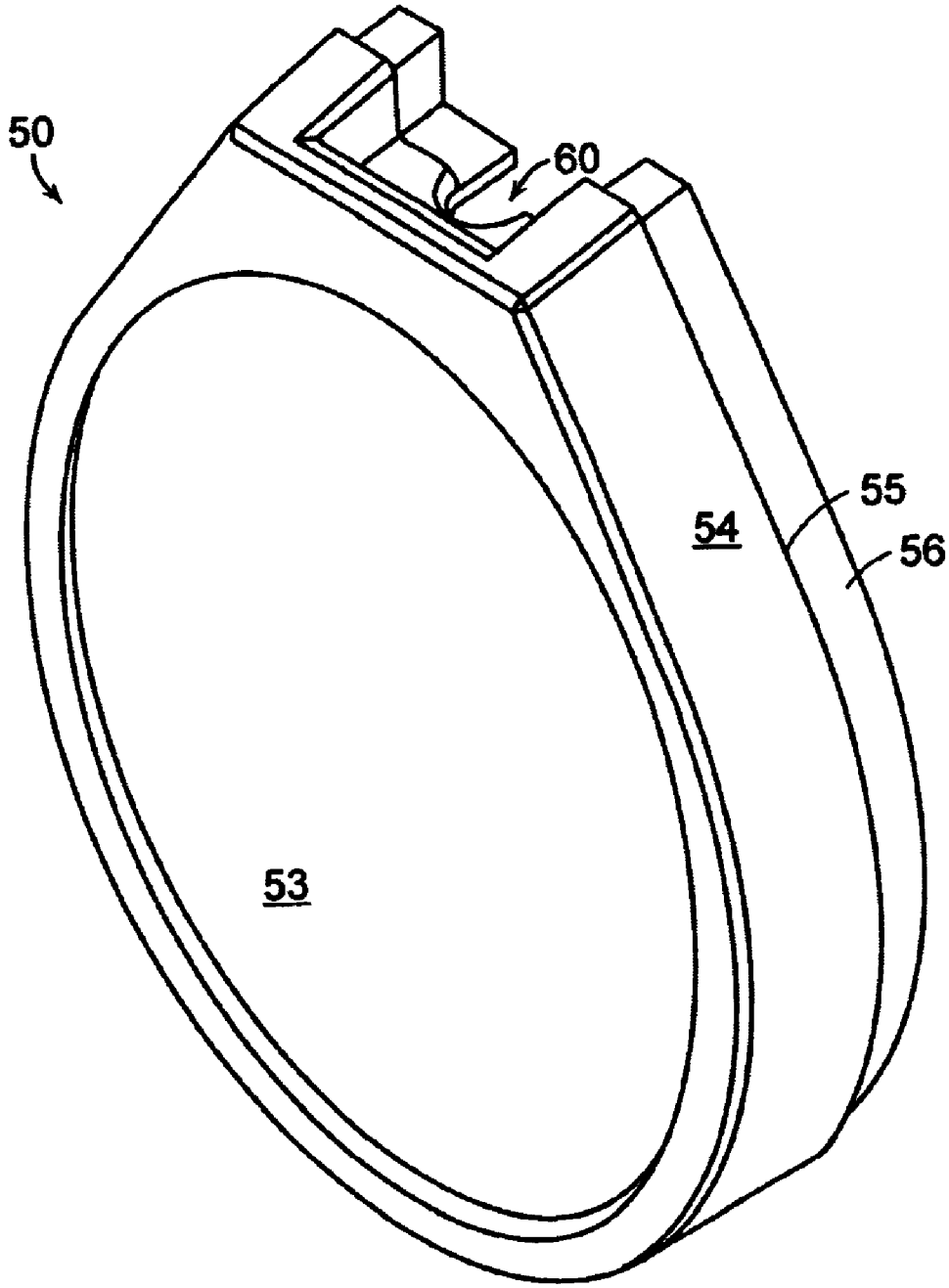
FIG. 4 is a perspective view of another embodiment of the billboard that includes a recessed portion.

As shown in FIG. 4, billboard 52 may optionally contain a recessed portion 53. This recessed portion is designed to accept a billboard insert containing the logo, not shown, that is adapted to fit into the recessed portion, preferably in a snap-fit fashion. Optionally, the billboard insert is removably accepted by the recessed portion; however, the billboard insert may be removably or permanently accepted by other means such as glues, adhesives, hook-and-loop, or other means. The recessed portion 53 and the billboard insert need not be of the same general shape as the case; for example a square recess and insert could be included in a round case.

Figure 5A:
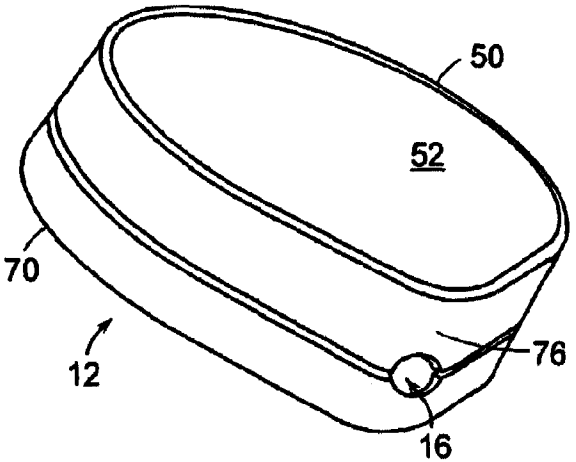
FIG. 5A is a perspective view of another embodiment of the billboard shown almost completely inserted into the back housing member.
Figure 5B:
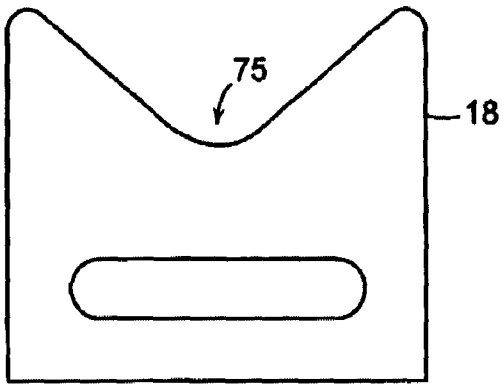
FIG. 5B is a front view of an embodiment of the bob that is designed to mate with the case embodiment shown in FIG. 5A.

In certain preferred embodiments of the present invention, case and the bob are configured such that a bob mating portion 75, when retracted against the case, mates with a mating portion 76 of the case to hold the bob rigidly against the case to advantageously prevent the bob from twisting and to force the bob, and through it a badge strap, clip, or other mounting fastener and the badge, into a set position upon the cord retracting, such that the badge will continue to face outward. Rigid, as defined herein, means the bob is held to minimize twisting and bending relative to the case and not that the bob is immovably affixed to the case. For the case shown in FIG. 3B, the bob would be of a square configuration; other examples of bob and case configurations are shown in FIGS. 5A and 5B and in FIGS. 6A, 6B and 6C. As can be seen, the mating portion of the case may comprise a recess, an indentation or a protrusion, with the bob correspondingly designed to mate with the mating portion. The configurations are not limited to those of the figures; any such configuration that permitted the bob to mate with the mating portion to be held rigidly against the case would suffice.

The above description includes a typical retractable badge reel design. It is noted that this design is only an example of one preferred embodiment and it is not intended that the present invention be limited to just this embodiment. Rather, any design that causes the cord 14 to be extendable or retractable could be substituted. Suitable designs would be readily apparent to one of ordinary skill in the art, given the benefit of the present disclosure.

Figure 6A:
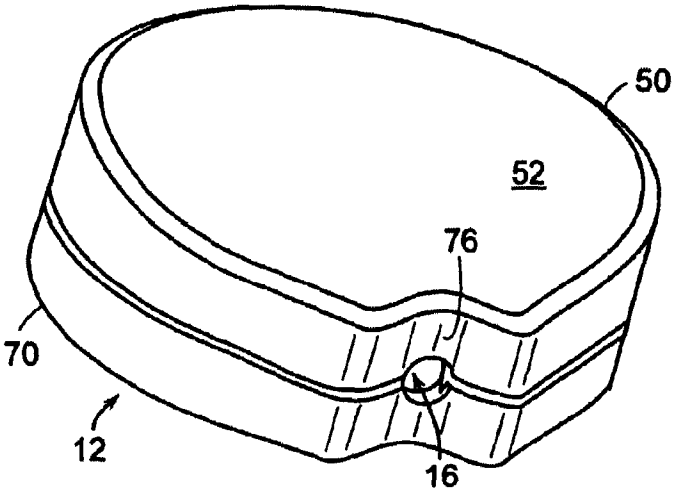
FIG. 6A is a perspective view of another embodiment of the billboard shown almost completely inserted into the back housing member.
Figure 6B:
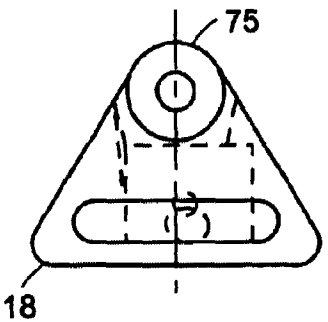
FIG. 6B is a front view of an embodiment of the bob that is designed to mate with the case embodiment shown in FIG. 6A.
Figure 6C:
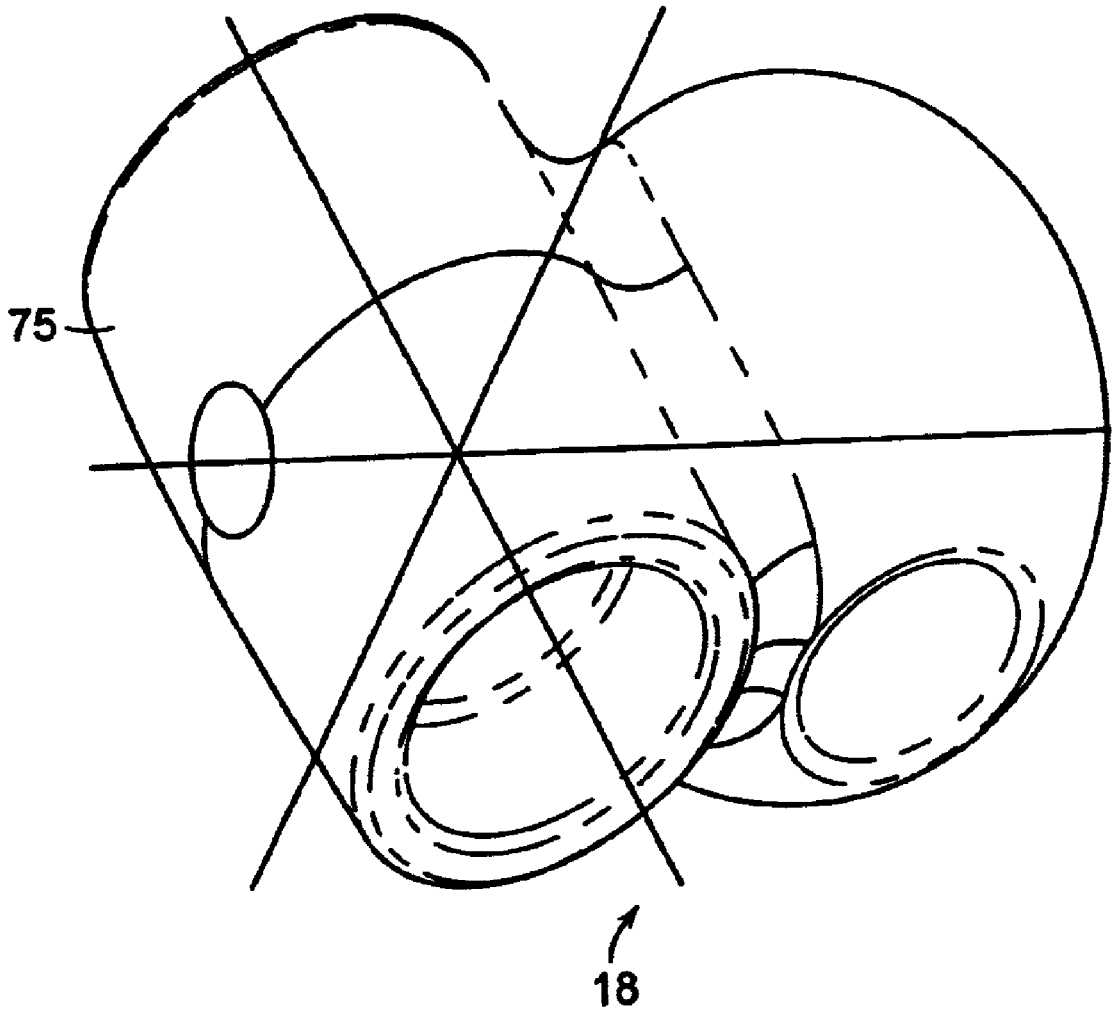
FIG. 6C is a perspective view of another embodiment of a bob that is designed to mate with the case embodiment shown in FIG. 6A.

In another embodiment of the present invention, a billboard is adapted to fit over the case of an existing retractable badge reel. Certain of these embodiments will comprise a billboard and a back housing member joined to form a casement such as shown in FIGS. 3B, 5A, and 6A that are sized and shaped so as to fit over the case such that the cord extends through both the port in the case and the port in the casement. Preferably, the billboard and the back housing member are releasably joined, for example by means of a snap-fit attachment.

In another embodiment, the billboard is adapted to fit over and attach to the case, preferably removably. An example of such would be a billboard with at least one side wall designed to match the shape of the existing case and comprising a small lip at the end of the side wall such that the side wall must be forced outward to push the billboard over the case. Once the lip had been extended beyond the depth of the case, the lip would snap over the edge of the case, releasably holding the billboard in place. The cord would then pass through the port in the original case and through the slot in the billboard.

Figure 8:
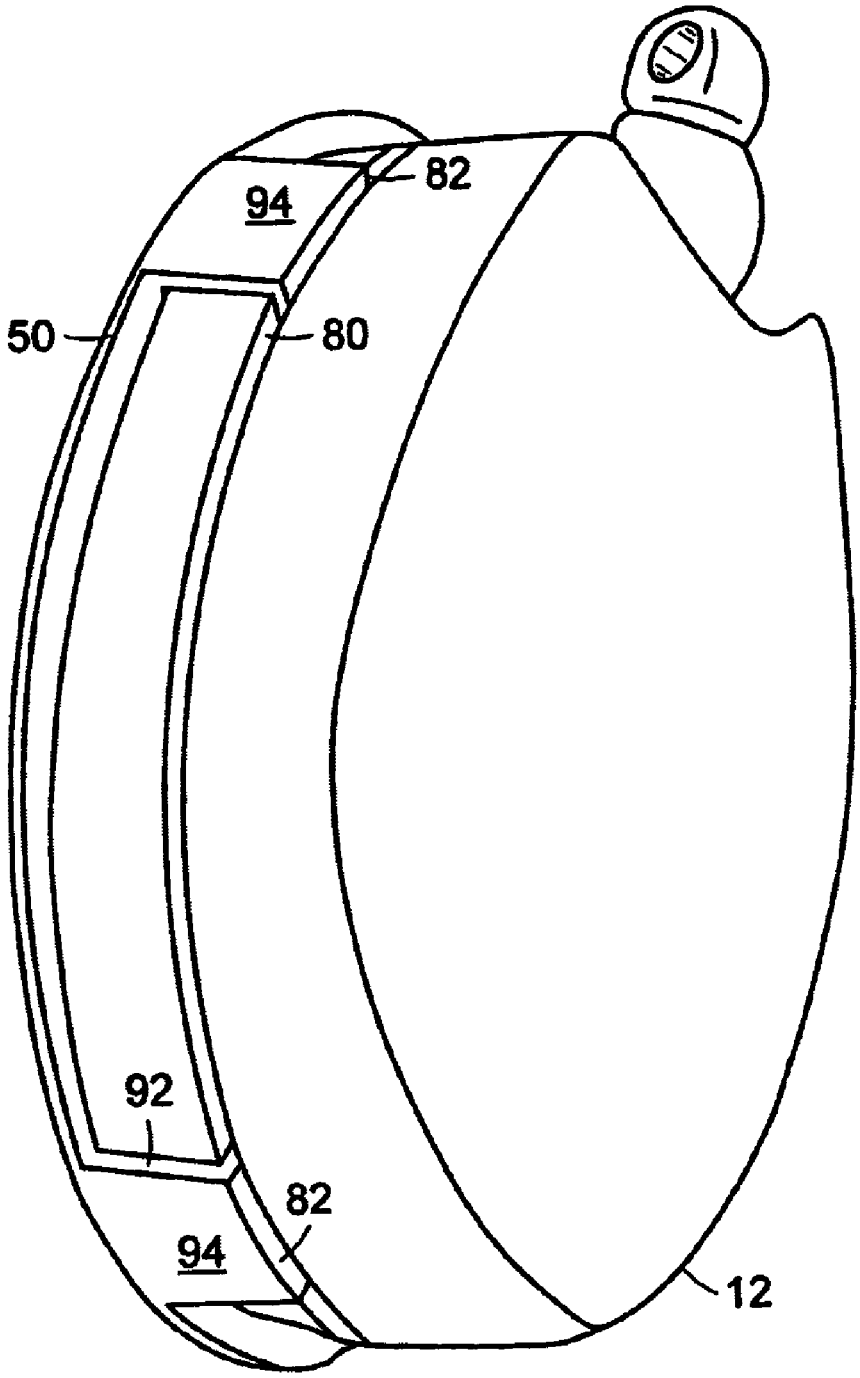
FIG. 8 is a perspective view of an embodiment of the billboard that is snap-fit to an existing badge reel unit.
Figure 9:
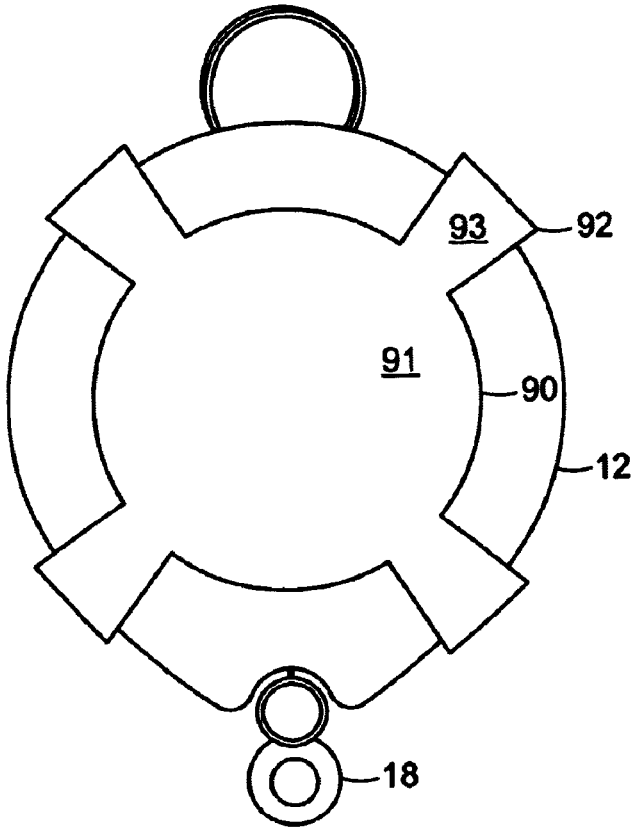
FIG. 9 is a head-on view of a billboard universal adapter attached to a badge reel case.
Figure 10:
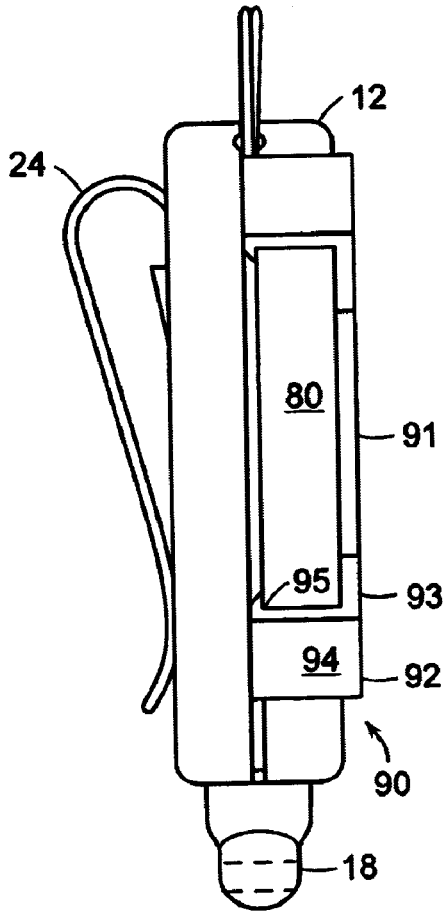
FIG. 10 is a side view of a billboard universal adapter attached to a badge reel case.
Figure 11:
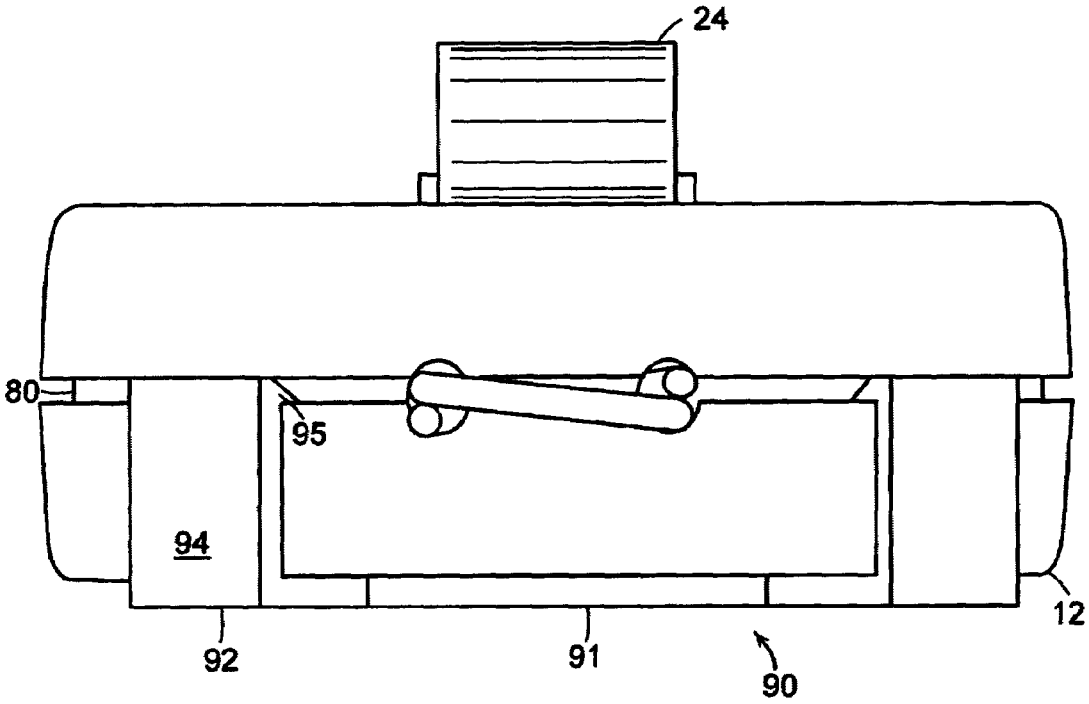
FIG. 11 is a top view of a billboard universal adapter attached to a badge reel case.
Figure 12:
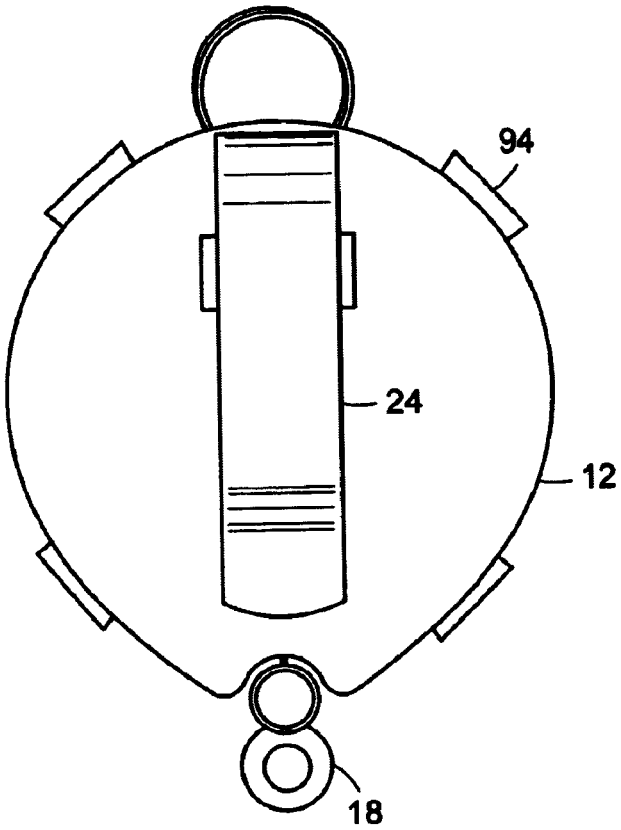
FIG. 12 is a back view of a billboard universal adapter attached to a badge reel case.
Figure 13:
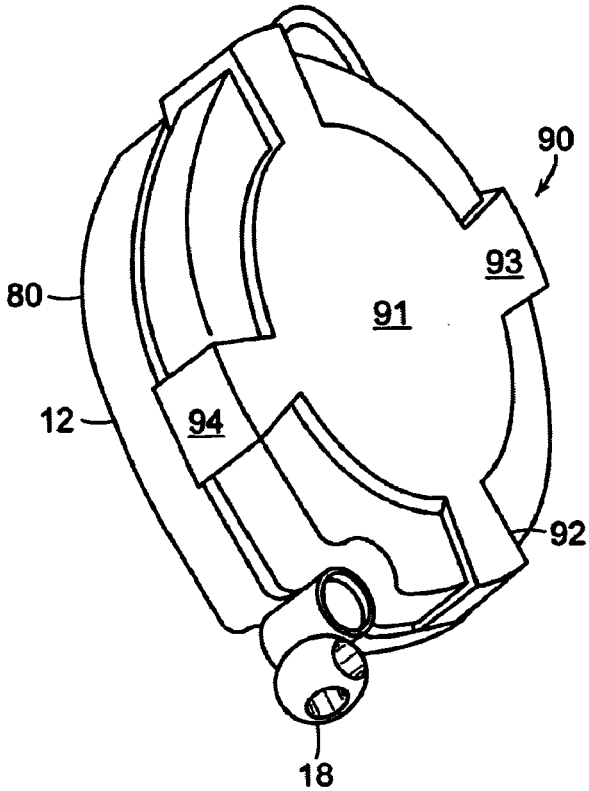
FIG. 13 is a perspective view of a billboard universal adapter attached to a badge reel case.
Figure 14:
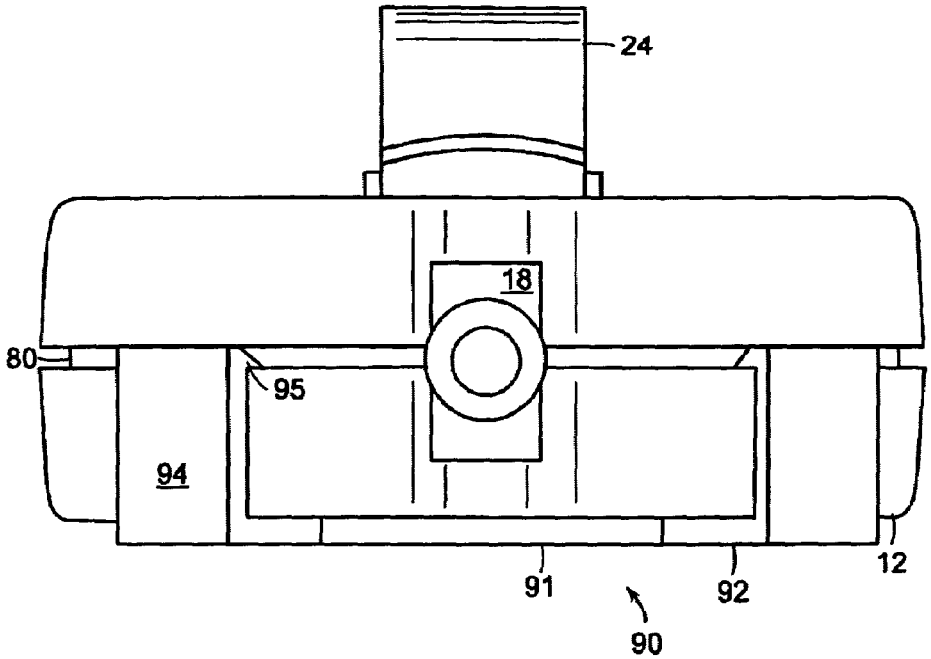
FIG. 14 is a bottom view of a billboard universal adapter attached to a badge reel case.

Alternatively, as seen in FIG. 8, the billboard can comprise mounting arms 92 that are optionally located away from the cord such that no slot for the cord to pass through is necessary in the billboard. The mounting arms include an extension 94, generally perpendicular to the front face of the billboard, ending in lip 82 that resides in a notch 80 on the case 12; alternatively, the mounting arms could extend to the back of the case so that the lips extended over the back surface of the case. Optionally the casement or billboard could include a mating portion adapted to rigidly mate with the particular bob found on the original retractable badge reel. Such a casement or billboard would advantageously cover any existing logo on the original retractable badge reel and optionally replace the logo with a new logo contained on the billboard.

Embodiments in which the billboard comprises a billboard universal adapter and a billboard attachment are shown in FIGS. 9–16. FIGS. 9–14 show embodiments of this type without showing the billboard attachment. The billboard universal adapter 90 comprises an attachment face 91 and at least two, preferably three, still more preferably four mounting arms 92. The mounting arms 92 optionally comprise a facial portion 93 that is substantially co-planar with the attachment face 91 of the universal adapter, and comprise extension 94 that is optionally perpendicular to the facial portion 93 and a lip 95 designed to fit into the notch 80 of the badge reel case 12. Optionally, the mounting arms are designed such that the lip fits over the back of the case 12 instead of into the notch.

Figure 15:
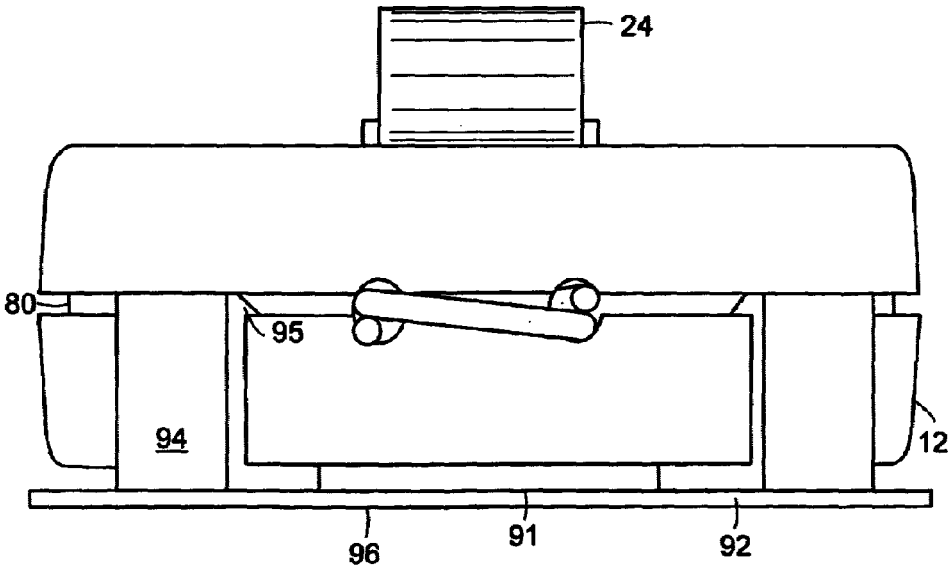
FIG. 15 is a top view of a billboard comprising a billboard universal adapter and a billboard attachment attached to a badge reel case.
Figure 16:
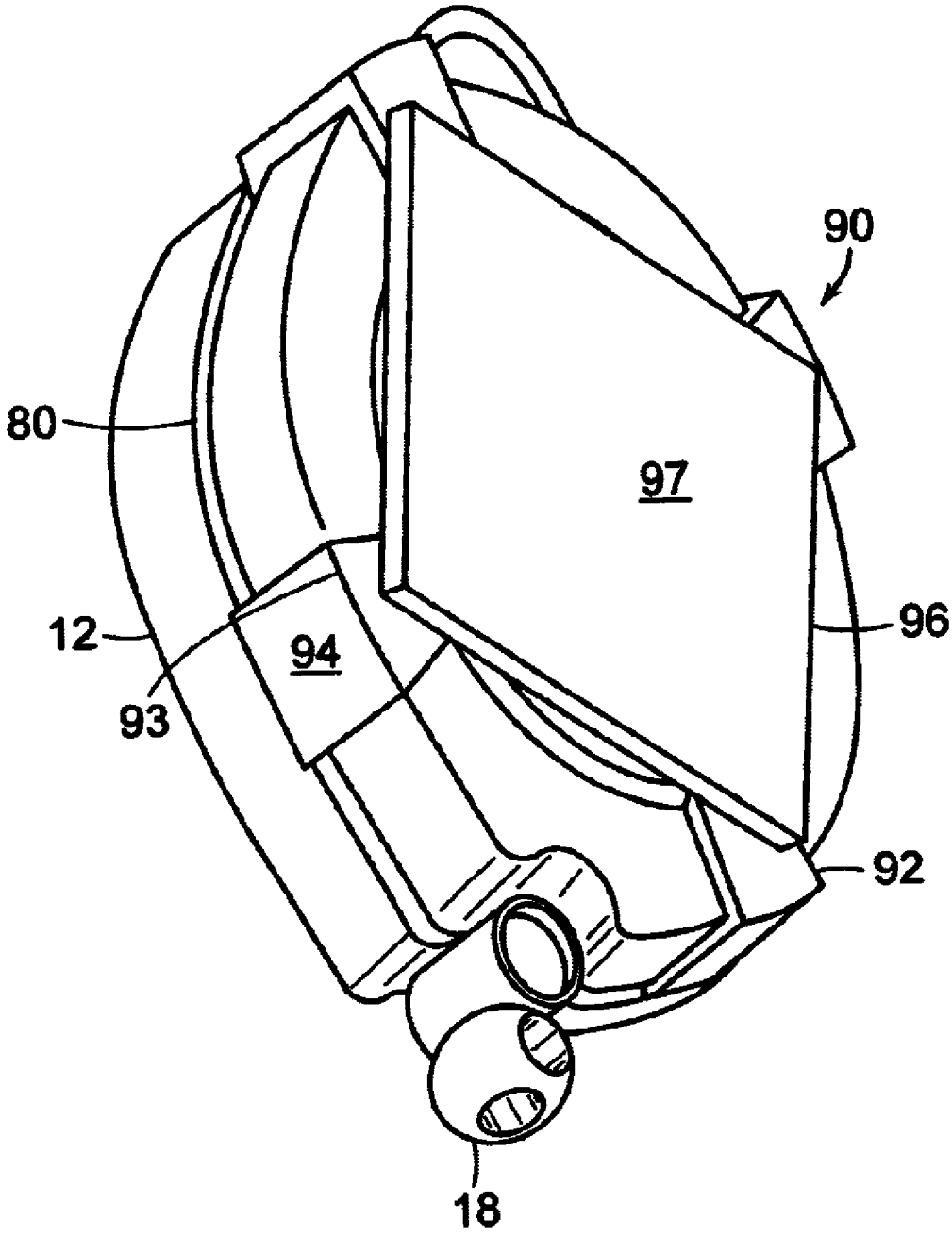
FIG. 16 is a perspective view of a billboard comprising a billboard universal adapter and a billboard attachment attached to a badge reel case.

FIGS. 15 and 16 show embodiments that include both the billboard universal adapter 90 and the billboard attachment 96. The billboard attachment 96 can be any size and shape desired, for example square, rectangular, circular, oval-shaped, irregularly-shaped, or any other suitable shape. Further, the billboard attachment can be smaller than the adapter, the same size as the adapter, or larger than the adapter, in some embodiments even larger than the badge reel case 12. The billboard attachment 96 comprises a front face 97 that accepts and displays the logo, and a back face at which the billboard attachment attaches to the attachment face 91 of the billboard universal adapter 90. The billboard universal adapter is "universal" in that the adapter can accept any of these billboard attachment sizes or shapes, and is interchangeable.

The attachment of the billboard attachment to the billboard universal adapter can be permanent or semi-permanent and can be accomplished by glue, weld or solvent weld, adhesive or any other suitable means for attachment. Preferably, either the attachment face 91 or the back face of the billboard attachment or both are coated with an adhesive layer such that the billboard attachment can simply be stuck or pressed on. Optionally, the attachment can be impermanent, as with snap fittings, slots into which the attachment, or extensions on the attachment, for example on the back face of the attachment, can fit, or hook-and-loop devices such as VELCRO. Other suitable permanent, semi-permanent and impermanent attachment means will be readily apparent to one of ordinary skill in the art, given the benefit of the current disclosure.

The logo can be incorporated into or onto the billboard attachment in a number of ways. For example, the logo could be formed into the front face 97 of the billboard attachment, such as by embossing. The logo could also be formed over the front face 97, for example using paint, ink or silkscreen. Alternately, the logo could be made using a label. In this latter case, the logo would be on a front side of the label, which would be attached to the billboard attachment front face by its back side. Yet another alternative would have a recessed portion, a slot, or a clear-faced sleeve on the front face of the billboard attachment adapted to receive a billboard insert, which could itself be imprinted, embossed, or labeled with the desired logo.

While the invention has been described in detail by reference to the preferred embodiment described above, it is understood that variations and modifications thereof may be made without departing from the true spirit and scope of the invention. For example, while the present invention has been described in the context of a badge reel, the billboard could be adapted to other devices as well. For example, keys are often carried by persons using a retractable key chain. In such a device, the keys are held close to the body of the key chain, which is typically attached to the clothing of the user. The keys are attached to a key ring, which is in turn attached to an extendable and retractable cord, similar to the one used in connection with the present invention. This retractable key chain could be modified in accordance with the present invention to include a billboard, with the same advantages as in the badge reel.

What is claimed is:

1. A retractable badge reel, comprising:

a case having a front face and a back face;

a securing unit which is capable of attachment to an article which is to be held by the badge reel, the securing unit being connected to an extendable and automatically retracting cord housed inside the case; and a billboard that fits over the front face of the case;

wherein the billboard has a front face adapted to display a logo; and wherein the billboard further comprises a billboard universal adapter that fits over the front face of the billboard and a billboard attachment that attaches to the billboard universal adapter and has a front face adapted to display a logo.

2. The badge reel of claim 1, further comprising a releasable attachment device connected to a backside of the case that is capable of releasably attaching the retractable badge reel to the clothing of a user.

3. The badge reel of claim 1, wherein the billboard is removable from the case.

4. The badge reel of claim 1, wherein the logo is embossed into the exterior facing side of the billboard.

5. The badge reel of claim 1, wherein the logo is formed over the surface of the exterior facing side of the billboard.

6. The badge reel of claim 5, wherein the logo formed over the surface of the exterior facing side of the billboard comprises one of (i) paint, and (ii) ink.

7. The badge reel of claim 1, wherein the billboard further comprises a label and wherein the logo is disposed on a front side of the label which acts as the exterior facing side of the billboard, and wherein the label is attached to the billboard by its back side.

8. The badge reel of claim 1, further comprising a back housing member, wherein the billboard and the back housing member are attachable to form a casement over the case.

9. The badge reel of claim 1, further comprising a free end of the cord which extends outside the case through a hole in the periphery of the case, and a badge securing unit which is capable of attachment to a badge and which is connected to the free end of the cord, comprising:

a bob which is connected to the free end of the cord, the bob being larger than the hole in the periphery of the case at its point of connection to the free end of the cord so as to prevent the free end of the cord from retracting into the case; and a badge fastener which is connected to the bob and releasably attachable to the badge, wherein the cord in a fully retracted mode holds the bob against the periphery of the case.

10. The badge reel of claim 9, further comprising a back housing member, wherein the billboard and the back housing member are attachable to form a casement over the case.

11. The badge reel of claim 10, wherein the casement comprises a mating portion that mates with a bob mating portion on the bob to hold the bob rigidly against the casement when the cord is in a retracted position.

12. The retractable badge reel of claim 1, wherein the billboard universal adapter is removable from the case.

* * * * *